United States Patent [19]

Traphagan

[11] 4,036,417

[45] July 19, 1977

[54] BOOK COVER AND CARRYING DEVICE

[76] Inventor: Seeran M. Traphagan, 1360 Kirkley Road, Columbus, Ohio 43221

[21] Appl. No.: 703,066

[22] Filed: July 6, 1976

[51] Int. Cl.[2] ..... B65D 77/00

[52] U.S. Cl. ..... 224/45 N; 2/DIG. 2; 112/441; 206/424; 281/19 R

[58] Field of Search ..... 224/45 N, 49, 55, 56, 224/57, 58; 150/52 R; 206/424; 2/DIG. 2; 112/10, 440, 441, 21, 22; 281/19 R, 19 A, 20, 21 R, 27, 29, 33, 34, 42; 283/64

[56] References Cited

U.S. PATENT DOCUMENTS

| | | | |
|---|---|---|---|
| 1,136,598 | 4/1915 | Gould | 224/47 |
| 1,492,677 | 5/1924 | Dunbar | 224/47 |
| 2,190,055 | 2/1940 | Davidson | 281/34 |
| 2,422,235 | 6/1947 | Greene | 224/47 |
| 2,523,129 | 9/1950 | Maier | 206/424 X |
| 2,926,932 | 3/1960 | Koerper | 281/34 |
| 3,044,517 | 7/1962 | Levi | 2/DIG. 2 |
| 3,347,428 | 10/1967 | Gauthier | 2/DIG. 2 |
| 3,710,394 | 1/1973 | Trice | 2/DIG. 2 |

FOREIGN PATENT DOCUMENTS

| | | | |
|---|---|---|---|
| 244,064 | 8/1946 | Switzerland | 283/64 |
| 404,750 | 1/1934 | United Kingdom | 281/34 |

*Primary Examiner*—L. J. Paperner
*Assistant Examiner*—Donald W. Underwood
*Attorney, Agent, or Firm*—Sidney W. Millard

[57] ABSTRACT

A cover and carrying arrangement for a book and method for the fabrication thereof. Through the use of continuous stitching of a first variety which is internally disposed in the completed article as well as continuous external or top stitching, a particularly high quality article is produced. With the method of the invention, such high quality is achieved at low unit manufacturing cost. In the production of the article, an initial assemblage is provided incorporating two body panel sheets the ornamentation carrying surfaces of which are adjacently disposed. Folded pocket panels as well as elongate handles of a loop variety are incorporated within the assemblage, all raw edges being aligned in coincidence. Initial stitching then is carried out leaving a gap through which the article is turned inside out. Following such turning, the edges adjacent the gap are turned inwardly and pressed and a continuous top stitching then is carried out. Where desired, a bookmark may be inserted within the gap prior to the latter stitching.

9 Claims, 5 Drawing Figures

BOOK COVER AND CARRYING DEVICE

BACKGROUND OF THE INVENTION

The resort and gift shop trades are continually seeking relatively small, imaginative and reasonably priced articles for presentation to the consumer public. Criteria for acceptance of such articles by the public vary somewhat, however, where an inherent quality of craftsmanship is exhibited in combination with relatively low cost, the articles tend to receive public acceptance. A combination of a readily apparent higher quality of craftsmanship with the noted reasonable or lower cost criterion often becomes difficult to realize.

Particularly with the rise in popularity of inexpensive "paperback books"a consumer interest has arisen in ornamental and yet practical book covers fashioned of a cloth carrying some ornamental design or aspect. Such covers may incorporate handles for facile carrying purposes as well as integrally attached bookmarks. Until the introduction of the present invention, however, book cover and carrying articles have exhibited crude fabrication techniques, not representative of desirable high quality craftsmanship, but lower cost, or have been formed of expensive, more rigid materials such as leather and/or provided in rather complex multifunctional combinations. Representative of such articles, for example, are those described in U.S. Pat. Nos. 1,136,598; 1,492, 677; 2,422,235; and 2,926,932.

SUMMARY

The present invention is addressed to a reusable type of book cover formed of a flexible limp material, such as cloth, which readily exhibits a high quality of craftsmanship, yet is fabricable at desirably low unit cost. Prefereably fashioned incorporating a pair of loop-type carrying handles constructed of the same flexible material, the book cover and carrying article is formed of a cloth having one surface exhibiting an ornamental design aspect and reveals a construction wherein its various components are not prone to tearing or ripping at seams and the like otherwise encountered in conventional lower cost articles of this nature.

A further object of the invention is to provide a cover for a book comprising a composite body panel which includes two substantially identically dimensioned sheets of flexible limp material with peripherally disposed raw edges. Each of these sheets is characterized in having one surface which carrys an ornamental aspect such as a color or combination of colors and design and is superimposed upon the other such that the ornamental surface of each is outwardly facing and the peripheries of each sheet are mutually inwardly folded along a margin spaced a select distance from each corresponding raw edge. Thus configured, a body panel periphery having a contour generally corresponding to the contours of the outer cover of a book, such as a standard paperback book when open, is provided. Additionally, the article incorporates first and second pocket panels, each present as a sheet of flexible limp material, each such sheet being symmetrically shaped about a centrally disposed fold line and having a surface carrying an ornamental aspect as above. The fold line is provided such as to expose the ornamental aspect type surface outwardly. The pocket panels are situated upon the composite body panel at mutually oppositely disposed portions of the body panel periphery to receive the cover of a selected book. Further, the pocket panel raw edges are superimposed in alignment with the body panel sheet raw edges and the peripheries of each pocket panel sheet, when the pocket panel sheet is folded about the noted fold line, are unidirectionally folded along a margin spaced a select distance from each corresponding raw edge thereof to define a three-sided pocket and panel periphery aligned with adjacent portions of the body panel periphery and defining therewith a pocket, as noted above, for receiving portions of the book outer cover. A first stitching is internally disposed within the composite body panel situate along and extending through the body panel sheet and pocket panel margins securing together the body panel sheets and the pocket panels. This stitching is substantially continuous along the periphery of the entire device with the exception of one small gap, thereby providing for a structure which is highly resistant to seam tearing and the like. A second or "top"stitching externally disposed and extending through the composite body panel and pocket panels also is provided to further reinforce the device. Handles formed of elongate sections of flexible limp material, such as cloth, are provided within the assembly and are retained in place both by the internally disposed stitching as well as the externally disposed top stitching.

Another object and feature of this invention provides a bookmark present as an elongate strip of flexible material which may be sewn and retained upon the body panel members intermediate the two sheets thereof by the noted external top stitching. Further, the attachment of the bookmark readily is reinforced by repeated top stitching.

Another feature and object of the invention is to provide a method for making a cover for a book formed of two substantially identically dimensioned body panel sheets and two pocket panels each formed of single, limp, flexible sheets, all the sheets having one surface representing an ornamental aspect. The method comprises the steps of superimposing the two body panel sheets one upon the other with the peripherally disposed raw edges thereof in coincidence and with the ornamental surface of each being arranged in mutually facing relationship. Each of the pocket panel sheets are folded in half such that the periphery disposed raw edges of each half are coincident and that the ornamental aspect carrying surfaces of each sheet are outwardly disposed. These folded pocket panel sheets are positioned intermediate the two body panel sheets at oppositely disposed locations such that there is a coincidence of the raw edges of both the pocket panel sheets and the adjacent body panel sheets. With such an arrangement, the folds of the pocket panel sheets are mutually facing and spaced a given distance apart. The thus provided assemblage of body panel sheets and folded pocket panel sheets is stitched along a first margin spaced inwardly a select distance from the corresponding body panel sheet raw edges and this stitching is carried out in a continuous fashion commencing and terminating within the space intermediate the pocket panel folds at one edge to define a singular gap. The assemblage then is turned inside out through this gap. Following such turning, an externally disposed top stitching through the entire assemblage along a second margin spaced from the first margin and continuous about the entire periphery of the body panel sheets is carried out.

As another object and feature, the method may include the steps of providing two loop-type handles each present as an elongat flexible limp material sheet having an ornamental aspect upon one surface and having elongate folds to externally dispose the ornament carrying surface and exhibit oppositely disposed ends having exposed raw edges. These loop-type handles are positioned within the earlier described assemblage intermediate a select body panel sheet and an adjacent folded pocket panel sheet in a manner wherein the ends of the handles are disposed in mutually spaced relationship and the exposed raw edges of them are coincident with the two body panel sheet raw edges and the folded pocket panel sheet raw edges. Thus positioned, the handles, prior to initial stitching, will extend within the assemblage intermediate the body sheets.

As a further object, the invention contemplates the step of folding, subsequent to the noted turning step, the raw edges of the body panel sheets extending along the noted gap defined during the initial stitching procedure along the first margin. The thus folded raw edges are pressed, by application of heat and pressure, prior to the externally applied top stitching. A bookmark may be inserted within the gap prior to the last stitching step and retained therein by reinforced double stitching or the like.

Other objects of the invention will, in part, be obvious and will, in part, appear hereinafter.

The invention, accordingly, comprises the article of manufacture and method of fabrication thereof possessing the construction, combination of elements and steps and arrangement of parts which are exemplified in the following detailed disclosure.

For a fuller understanding of the nature and objects of the invention, reference should be held to the following detailed description taken in connection with the accompanying drawings.

DETAILED DESCRIPTION

Figure 1:
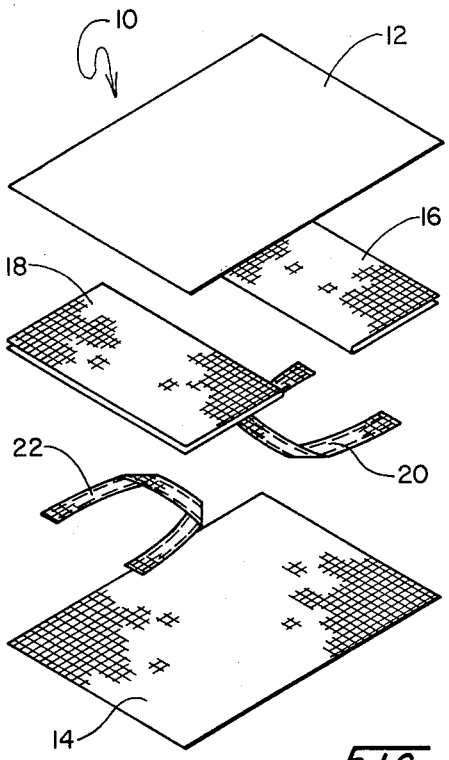
FIG. 1 is an exploded perspective view of an assemblage of components ultimately forming the article of the invention, revealing the relative positioning, of components during an initial stage in the fabrication thereof.

In the discourse to follow, both the method of construction as well as the structure of the book cover and carrying article are described together in the interest of clarity. Looking to FIG. 1, an exploded view of the article is revealed generally at 10. Article 10 comprises a composite body panel which is formed of two substantially identically dimensioned sheets of flexible limp material as at 12 and 14. This material, coventionally a cloth which carries an ornamental aspect such as a solid color or color with design, merely a design or the like on one surface is pre-cut in the rectangular shape shown, such that panels 12 and 14 are of substantially identical dimension and contour. The surface of the material carrying the design or ornamental aspect is represented in FIG. 1 by cross-hatching. When thus provided, the rectangularly shaped sheets 12 and 14 will exhibit "raw" edges about the peripheries thereof, the term "raw" edges conventionally being considered in the art as an edge which has not been treated or manipulated, as a folded seam or the like. The size of sheets 12 and 14 is selected in correspondence with a conventional book outer covering size and, as will become apparent, this dimensioning is slightly greater than the contour of the outer cover of a book when open.

The assemblage of FIG. 1 further includes two pocket panels 16 and 18 which also are formed of sheets of flexible limp material with peripherally disposed raw edges. These sheets are of generally rectangular configuration and have a widthwise dimension equal to the corresponding widthwise dimension of panel sheets 12 and 14. Sheets 16 and 18 are folded symmetrically in half along a fold line in a manner outwardly exposing the surface of the material or cloth carrying an ornamental aspect, as revealed in cross-hatched fashion in the figure. The pocket panels 16 and 18 further are positioned intermediate composite body panel sheets 12 and 14 at mutually oppositely disposed portions of the periphery thereof and the raw edges of the folded pocket panels 16 and 18 are superimposed in alignment with the corresponding raw edges of body panel sheets 12 and 14.

This preliminary assemblage further includes two loop-type handles 20 and 22 each of which preferably is formed of an elongate sheet of flexible limp material such as cotton cloth or the like which, as before, carries an ornamental aspect upon one surface. This sheet is folded along elongate fold lines to externally expose the ornamental surface and is pressed or the like to provide an elongate material strip having a folded seam along one edge. These strips then are pre-sewn externally, preferably along both edges as revealed in the drawings. Note, however, that raw edges are present only at the ends of each of the handles 20 and 22. Handles 20 and 22 are arranged in the preliminary assemblage of FIG. 1 such that they are disposed internally or intermediate sheets 12 and 14 and against one side of pocket panel sheets 18 and 16. The raw edge end portions of handles 20 and 22 are arranged in mutually spaced relationship and aligned with the corresponding raw edges of body panel sheets 12 and 14 as well as an associated or adjacent pocket panel as at 18 or 16. Note in this regard, that the raw edges of the ends of handle 22 are coincident with the corresponding raw edges of sheets 14, 18 and 12, while the raw edges of the ends of handle 20 are coincident with the raw edges of sheets 14, 16 and 12. Preferably, handles 20 and 22 are arranged within the assemblage of FIG. 1 such that the seam provided during the folding and stitching thereof are mutually facing each other towards the center of the handle loops.

Figure 2:
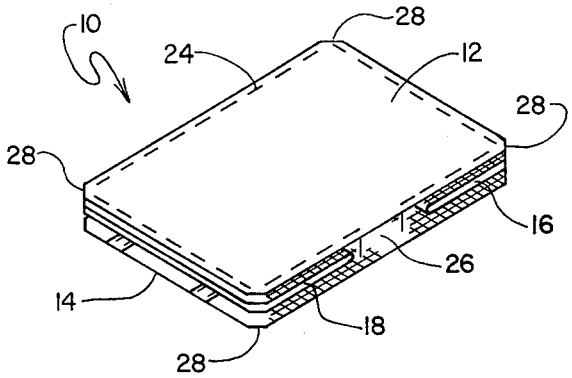
FIG. 2 is a perspective and slightly exploded view of the assemblage of FIG. 1, showing the orientation of components thereof subsequent to an initial stitching procedure.

Looking to FIG. 2, the preliminary assemblage of FIG. 1 is revealed in slightly exploded fashion. The figure shows the positioning of initial stitching as depicted by the dashed line 24. As is apparent, the components of FIG. 1 are readily assembled and, following such assembly, they are stitched together about a margin spaced inwardly from the raw edges of the assemblage a predetermined distance selected both in accordance with the seam strength desired as well as the general contour of the open book over which the cover is to be positioned. This stitching, as at 24, commences at one side of a gap designated at 26 and continuously progresses about the periphery of the assemblage until terminated at the opposite side of gap 26. Note that the stitching is both continuous and extends beyond the fold line of pocket panel sheets 16, 18. As will become more apparent, this initial stitching is ultimately internally disposed and is continuous beyond the edges of the pocket components of the finished product. To retain the handles 20 and 22 in appropriate position during stitching, they may be pinned or basted in accordance with the particular desires of the operator.

Figure 3:
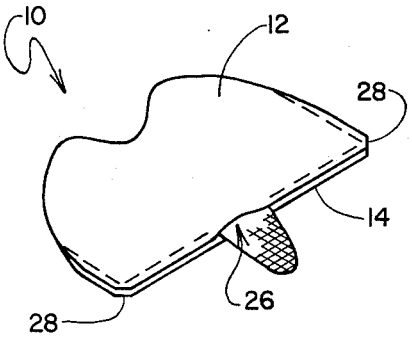
FIG. 3 is a fragmentary view of the assemblage of FIG. 2 revealing a turning procedure.

Looking to FIG. 3, following completion of stitching along margin 24, the assemblage is turned inside out by drawing it through the gap 24. This maneuver internally disposes stitching 24 and provides for a "right side" exposure of all the components of the article. To facilitate turning, the corners of the assemblage as in FIG. 2, may be clipped off as revealed at 28 in FIGS. 2 and 3. Generally, it is conventional to "pick" the corners following the turning operation to assure a desired squareness thereof.

Figure 4:
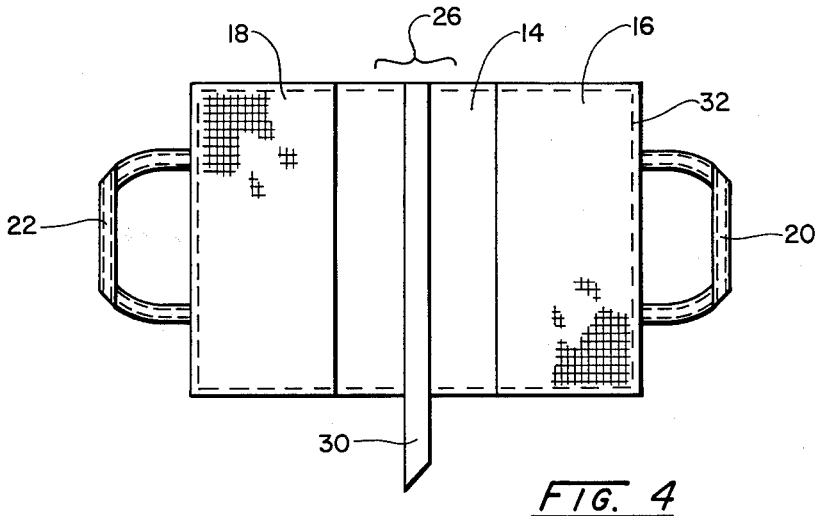
FIG. 4 is a plan view of the book cover and carrying article of the invention revealing the relative positioning of components and position of final stitching.
Figure 5:
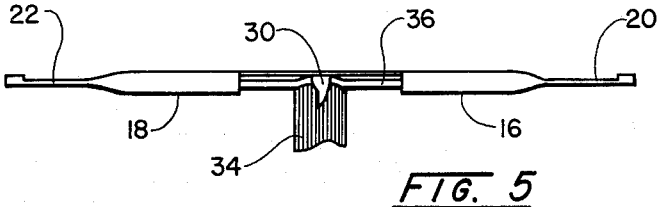
FIG. 5 is an end view of the completed book cover and carrying article showing its utilization in association with a book.

Following turning as in FIG. 3, those portions of the edges of sheets 12 and 14 defining gap 26 are folded inwardly and pressed through application of heat and pressure. Looking to FIG. 4, if preferred, one end of an elongate, limp material bookmark 30 may be inserted within gap 26. Following such insertion and the folding mutually inwardly and pressing of the edge portions of sheets 12 and 14 at gap 26, a top stitching, revealed by dashed line 32 is carried out. This stitching is continuous completely around the periphery of the assembly and serves additionally to close gap 26 as well as secure bookmark 30. Preferably, double stitching is carried out over the point of connection of bookmark 30. As is apparent, the positioning of the marginal stitching at 32 is selected in correspondence with the size or the contour of the book intended to be utilized with the cover and is relatively close to the internally disposed stitching described hereinabove in connection with dashed line 24. The resultant article is one exhibiting a high quality of craftsmanship and in the same vein, exhibits an immunity from ripping at the seams. In particular, the article is immune from seam ripping at the otherwise vulnerable locations between the fold lines of pocket panel sheets 18 and 16 and adjacent body panels. While providing such quality, the article further is fabricated, utilizing the above procedures, in an advantageously economical fashion, thereby permitting lower production unit costs. A typical positioning of the article on a book 34 having cover 36 is shown in FIG. 5.

Since certain changes may be made in the above-described article and method without departing from the scope of the invention herein involved, it is intended that all matter contained in the description thereof as shown in the accompanying drawings shall be interpreted as illustrative and not in a limited sense.

I claim:

1. A cover for a book comprising:

a composite body panel including two substantially identically dimensioned sheets of flexible limp material with peripherally disposed raw edges, each said sheet having one surface carrying an ornamental aspect and being superimposed upon the other such that each said one surface is outwardly facing, the peripheries of each said sheet being mutually inwardly folded along a margin spaced a select distance from each corresponding said raw edge to define a body panel periphery having a contour generally corresponding to the contour of the outer cover of said book when open:

first and second pocket panels, each present as a sheet of flexible limp material with peripherally disposed raw edges, each said sheet being symmetrically shaped about a centrally disposed fold line, having one surface carrying an ornamental aspect and folded about said fold line to outwardly expose said one surface, each said folded first and second pocket panels being situated upon said composite body panel at mutually oppositely disposed portions of said body panel periphery, said pocket panel raw edges being superimposed in alignment with said body panel sheet raw edges, the peripheries of each said pocket panel sheet, when said pocket panel sheet is folded about said fold line, being unidirectionally folded along a margin spaced a select distance from each corresponding said raw edge thereof to define a three-sided pocket panel periphery aligned with adjacent said portions of said body panel periphery and defining therewith a pocket for receiving portions of said book outer cover;

first stitching internally disposed within said composite body panel, situate along and extendig through said body panel sheet and pocket panel margins, securing together said body panel sheets and said first and second pocket panels, continuous adjacent said aligned and superimposed pocket panel and body panel raw edges, and continuous along said body panel margin at least a select distance beyond said first and second pocket panel margins;

second stitching extending through said composite body panel and said first and second pocket panels, disposed outwardly thereupon and continuous along a margin spaced inwardly from said body panel periphery; and first and second loop-type handles, each present as an elongate flexible limp material sheet having an ornamental aspect upon one surface thereof, folded along elongate fold lines to externally dispose said one surface, stitched to internally position the raw edges disposed in said elongate sense and to define oppositely disposed ends having exposed raw edges, said ends being internally disposed in spaced relationship within said composite body panel and secured thereto by said first and second stitching.

2. The cover of claim 1 in which said first and second pocket panel sheets are identically dimensioned and rectangularly configured.

3. The cover of claim 1 in which said composite body panel sheets are of generally rectangular shape.

4. The cover of claim 1 including a bookmark comprising an elongate strip of flexible, limp material one end of which is internally disposed within said composite body panel and is secured thereto by said second stitching.

5. The method of making a cover for a book formed of two substantially identically dimensioned body panel sheets and two pocket panels each said body panel and pocket panel sheet being present as a single, limp, flexible sheet having one surface representing an ornamental aspect, the method comprising the steps of:

superimposing said two body panel sheets one upon the other with the peripherally disposed raw edges thereof being coincident and said one surface of each being arranged in mutually facing relationship;

folding symmetrically each said pocket panel sheet in half, the peripherally disposed raw edges of each half being coincident and said one surface of each being outwardly disposed when so folded;

positioning a said folded pocket panel sheet intermediate said two body panel sheets are oppositely disposed locations, said coincident raw edges of each said folded pocket panel sheet being coincident with adjacent said raw edges of each said body panel sheet and said folds therein being disposed in facing parallel relationship and spaced a given distance apart;

stitching through the assemblage of said body panel sheets and said folded pocket panel sheets, said stitching being located along a first margin spaced inwardly a select distance from corresponding said body panel sheet raw edges, said stitching being carried out in continuous fashion and commencing and terminating within a said space intermediate said pocket panel folds to define a gap;

turning said assemblage inside-out through said gap; and stitching through said turned assemblage along a second margin spaced from said first margin and continuously about the entire peripheries of said body panel sheets.

6. The method of claim 5 including the steps of providing two, loop-type handles each present as an elongate flexible limp material sheet having an ornamental aspect upon one surface thereof and having elongate folds to externally dispose said one surface and exhibit oppositely disposed ends having exposed raw edges; and positioning each of said handles within said assemblage intermediate a select said body panel sheet and adjacent said folded pocket panel sheet in a manner wherein said ends are disposed in mutually spaced relationship and said exposed raw edges thereof are coincident with said two body panel sheet raw edges and said folded pocket panel raw edges.

7. The method of claim 5 including the steps of folding, subsequent to said turning, the said raw edges of said body panel sheets extending along said gap mutually inwardly along said first margin; and pressing along said folds, by the application of heat and pressure, prior to said stitching along said second margin.

8. The method of claim 7 including the step of inserting subsequent to said pressing and prior to said stitching along said second margin, one end of a bookmark, present as an elongate strip of flexible, limp material, intermediate said body panel sheets within said gap.

9. The method of claim 7 including the steps of providing two, loop-type handles each present as an elongate flexible limp material sheet having an ornamental aspect upon one surface thereof and having elongate folds to externally dispose said one surface and exhibit oppositely disposed ends having exposed raw edges; and positioning each of said handles within said assemblage intermediate a select said body panel sheet and adjacent said folded pocket panel sheet in a manner wherein said ends are disposed in mutually spaced relationship and said exposed raw edges thereof in mutually spaced relationship and said exposed raw edges thereof are coincident with said two body panel sheet raw edges and said folded pocket panel raw edges.

* * * * *